US007509942B2

(12) United States Patent
Knight et al.

(10) Patent No.: US 7,509,942 B2
(45) Date of Patent: Mar. 31, 2009

(54) FUEL SYSTEM

(75) Inventors: Andrew R Knight, Stroud (GB); Adam Wilkin, Cheltenham (GB)

(73) Assignee: Delphi Technologies, Inc., Troy, MI (US)

( * ) Notice: Subject to any disclaimer, the term of this patent is extended or adjusted under 35 U.S.C. 154(b) by 343 days.

(21) Appl. No.: 10/561,773

(22) PCT Filed: Jun. 17, 2004

(86) PCT No.: PCT/GB2004/002578

§ 371 (c)(1),
(2), (4) Date: Dec. 20, 2005

(87) PCT Pub. No.: WO2004/113715

PCT Pub. Date: Dec. 29, 2004

(65) Prior Publication Data

US 2006/0144368 A1 Jul. 6, 2006

(30) Foreign Application Priority Data

Jun. 20, 2003 (EP) ..... 03253919

(51) Int. Cl.
*F02M 33/02* (2006.01)
*F02M 51/00* (2006.01)

(52) U.S. Cl. ..... 123/456; 123/509

(58) Field of Classification Search ..... 123/446, 123/447, 299, 300, 509, 470, 456
See application file for complete search history.

(56) References Cited

U.S. PATENT DOCUMENTS 4,543,045 A * 9/1985 Ritter et al. ..... 417/499
4,640,255 A * 2/1987 Hafele et al. ..... 123/495
5,398,658 A * 3/1995 Mesimaki ..... 123/509
5,622,152 A * 4/1997 Ishida ..... 123/446
5,771,865 A * 6/1998 Ishida ..... 123/467
5,806,494 A 9/1998 Glassey
6,145,493 A * 11/2000 Espey ..... 123/509
6,405,711 B1 * 6/2002 Smith et al. ..... 123/456
6,457,453 B1 * 10/2002 Tanabe et al. ..... 123/300
6,467,457 B1 * 10/2002 Lei et al. ..... 123/456
6,508,231 B2 * 1/2003 Boecking ..... 123/456

(Continued)

FOREIGN PATENT DOCUMENTS

DE 10136925 12/2002

(Continued)

*Primary Examiner*—Thomas N Moulis
(74) *Attorney, Agent, or Firm*—David P. Wood

(57) ABSTRACT

A fuel system for supplying pressurised fuel to a plurality of fuel injectors (14*a*-14*f*) comprises an accumulator assembly (16) having first and second accumulator volumes (18, 20) defined within a common accumulator housing (22), supply means (42) for supplying fuel at a supply pressure level to the first accumulator volume (18) and a plurality of unit pumps (10*a*-10*f*). Each unit pump is arranged to receive fuel at the supply pressure level from the first accumulator volume (18) and pressurises said fuel to an injectable pressure level for supply to the second accumulator volume (20). Each unit pump (10*a*-10*f*) includes a pumping plunger (50) for pressuring fuel within an associated pump chamber (52) and being integrated with the accumulator housing (22) so as to permit communication between the first accumulator volume (18) and the pump chamber (52) internally within the accumulator housing (22).

15 Claims, 4 Drawing Sheets

U.S. PATENT DOCUMENTS

| | | | | |
|---|---|---|---|---|
| 6,644,282 | B2 * | 11/2003 | Schwarz | 123/467 |
| 6,684,855 | B2 * | 2/2004 | Murakami et al. | 123/446 |
| 6,745,753 | B2 * | 6/2004 | Spinnler et al. | 123/509 |
| 6,814,057 | B2 * | 11/2004 | Mahr et al. | 123/446 |
| 6,845,758 | B2 * | 1/2005 | Seymour et al. | 123/470 |
| 7,213,575 | B2 * | 5/2007 | Moschini et al. | 123/468 |
| 2004/0168673 | A1 * | 9/2004 | Shinogle | 123/456 |
| 2006/0042597 | A1 * | 3/2006 | Magel | 123/446 |

FOREIGN PATENT DOCUMENTS

| | | |
|---|---|---|
| EP | 0861380 | 9/1998 |
| EP | 0976926 | 2/2000 |
| WO | WO/02/50417 | 6/2002 |

* cited by examiner

Fig.1
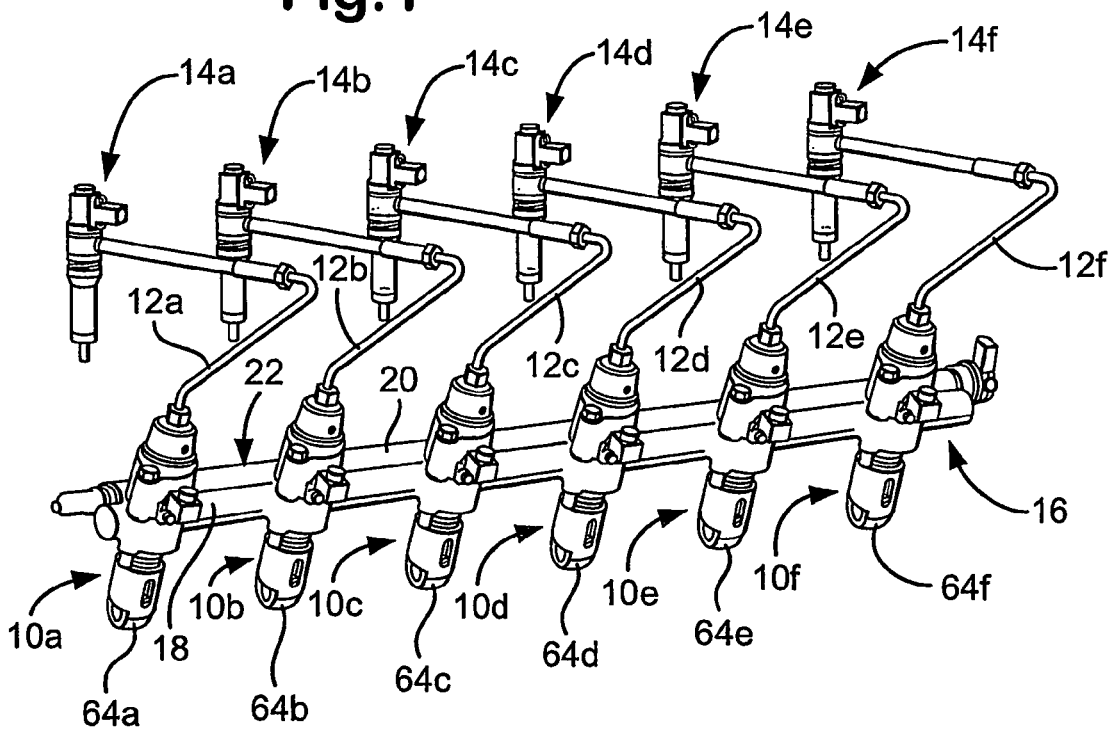
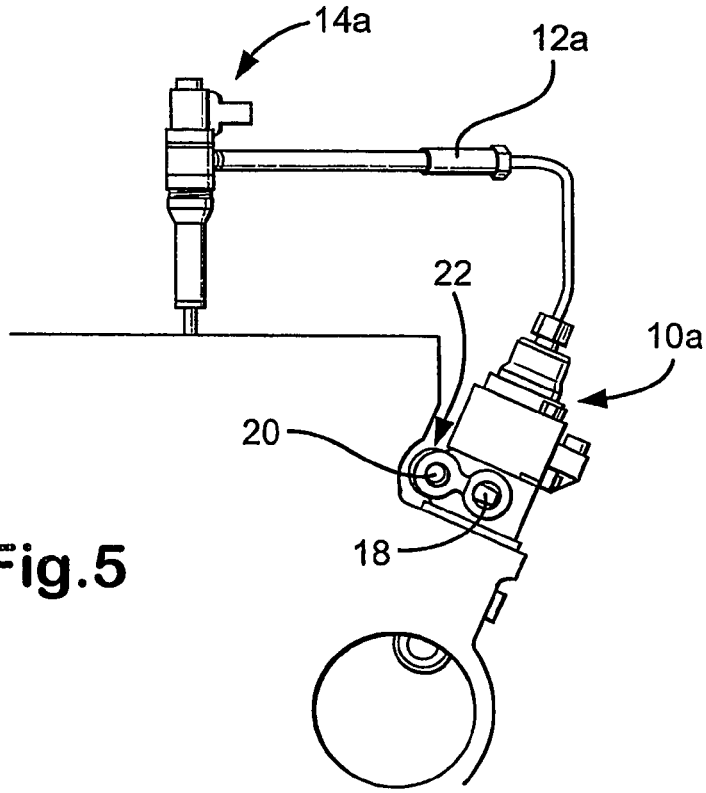
Fig.5

FUEL SYSTEM

BACKGROUND AND SUMMARY OF THE INVENTION

The present invention relates to a fuel system for an internal combustion engine and, in particular, to a fuel system including an accumulator volume in the form of a common rail for supplying fuel to a plurality of injectors.

In conventional common rail fuel injection systems, it is common to provide a single pump for charging an accumulator volume, or common rail, with high pressure fuel for supply to a plurality of injectors of the fuel system. The timing of injection is controlled by means of a nozzle control valve associated with each injector. One advantage of the common rail system is that the timing of injection of fuel at high pressure is not dependent upon a cam drive mechanism, and so fast and accurate control of the timing of injection can be achieved with the nozzle control valves. However, achieving very high injection pressure within a common rail system is problematic and the high levels to which fuel must be pressurised can cause high stresses within the pump and within the rail. The rail must therefore be provided with a relatively thick wall for pressure containment, making it heavy and bulky. Parasitic fuel losses can also be high.

It has been recognised that significant improvements in combustion quality and efficiency may be achieved by rapidly varying the injection pressure level and injection rate within an injection event. Such variations in the injection characteristics can be difficult to achieve rapidly with common rail systems, and the efficiency of the system can be limited. For example, in a common rail system designed to achieve injection at a high rail pressure, it is also possible to achieve a lower injection pressure by relieving some of the high pressure fuel to a low pressure reservoir. This, however, is an inefficient use of pumping energy.

By way of background to the present invention it is acknowledged that Electronic Unit Pumps (EUPs) provide a different fuel system concept to that of the common rail system. In an EUP fuel system, one EUP is provided for each cylinder of the engine and has a dedicated injector to which pressurised fuel is supplied by the EUP for injection purposes. The EUP includes a dedicated pump having a cam-driven plunger for raising fuel pressure within a pump chamber, from where pressurised fuel is supplied to the associated injector. In an EUP system, however, the constraints of the cam drive mechanism can limit the range of injection timing that can be achieved. It is also acknowledged that Electronic Injectors (EUIs) are known, in which the associated injector is incorporated within the same unit as its dedicated plunger and injection is controlled by means of a nozzle control valve of the unit.

It is one aim of the present invention to provide a common rail fuel system which provides improvements over known common rail fuel systems and which addresses, in particular, the issue of variable injection characteristics and of parasitic fuel losses so as to provide enhanced system efficiency.

According to a first aspect of the present invention there is provided a fuel system for supplying fuel to a plurality of injectors, the fuel system comprising;

an accumulator assembly having first and second accumulator volumes defined within a common accumulator housing, supply means for supplying fuel at a supply pressure level to the first accumulator volume, a plurality of unit pumps, each for receiving fuel at the supply pressure level from the first accumulator volume and for pressurising said fuel to an injectable pressure level for supply to the second accumulator volume, each unit pump including a pumping plunger for pressuring fuel within an associated pump chamber, wherein the unit pump is integrated with the accumulator housing so as to permit communication between the first accumulator volume and the pump chamber internally within the accumulator housing.

Preferably, each unit pump is integrated with the accumulator housing by mounting within an opening or cross bore provided in the accumulator housing, so that the unit pumps pass through the accumulator housing.

The accumulator assembly is preferably a rail assembly comprising a first rail volume (the first accumulator volume) and a second rail volume (the second accumulator volume) housed within a rail housing (the accumulator housing).

It is a particular benefit of the fuel system of the present invention that a first rail volume for lower pressure fuel may be arranged adjacent to, side by side or in parallel with a second rail volume for higher pressure fuel, within a common rail housing, and thus a cooling effect is provided for high pressure fuel within the second rail volume.

In a further preferred embodiment the assembled unit pump and rail assembly, forming an integrated pump/rail assembly, is configured such that each unit pump is received within the accumulator housing so as to permit communication between the second accumulator volume and its pump chamber internally within the pump/rail assembly, with the communication path conveniently traversing an interface between unit pump and rail housings.

Preferably, a plurality of unit pumps are provided, equal in number to the number of injectors to which fuel is to be supplied.

The first rail volume may be communicable with the pump chamber of each unit pump within the actuator housing via first valve means, typically in the form of a non-return valve. The first valve means has an open position, in which the pump chamber communicates with the first rail volume, and a closed position in which said communication is broken.

It is a particular benefit of being able to inject fuel at two pressure levels, that a sequence of a main injection of fuel having a second (higher) pressure level followed by a post injection of fuel having a first (moderate) pressure level can be achieved and this can have benefits for after-treatment purposes. It is also desirable to inject a pilot injection of fuel at a first pressure level followed by a main injection of fuel at a second pressure level, or to provide a boot-shaped injection characteristic, which also provides benefits in terms of engine noise and emissions levels.

The fuel system therefore preferably includes second valve means, wherein the second rail volume is communicable with the pump chamber of each unit pump through the second valve means.

Preferably, the second valve means is a rail control valve which is operable between an open position in which a supply of fuel at the injectable pressure level, being the first injectable pressure level, is supplied from the second rail volume to the injectors of the system and a closed position in which communication between the pump chamber and the second rail volume is broken so that the unit pump is operable to increase fuel to a second injectable pressure level.

Conveniently the rail control valve and/or the non-return valve form an integral part of the unit pump, being contained within a common pump housing.

In a preferred embodiment, the plunger of each unit pump is movable within the plunger bore to perform a pumping cycle having a pumping stroke and a return stroke. During the plunger pumping stroke, pressurisation of fuel occurs within the pump chamber. During the plunger return stroke, the pumping chamber is filled with fuel to be pressurised during the following pumping stroke.

Each unit pump is preferably driven by means of a cam arrangement, with the plunger co-operating with a drive member, such as a tappet, to effect plunger motion. A cam follower such as a roller may be provided for driving the drive member in response to rotation of an engine driven cam, so as to drive plunger movement.

It will be appreciated that the fuel system may, but need not, include the fuel injectors and may, but need not, include respective high pressure supply passages for supplying fuel from the pump chamber of each unit pump to an associated one of the injectors.

In one particular embodiment, each unit pump forms an EUI-type unit, in which the unit pump is incorporated with an associated injector (electronically controlled) within a common pump/injector unit. The requirement for a high pressure supply passage between the unit pump and its associated injector is avoided in this embodiment.

The system may include control valve means operable to control the timing of commencement of injection at a first and/or second injectable pressure level. The control valve means may, in a first embodiment, include a nozzle control valve that is operable to control fuel pressure within an injector control chamber so as to permit control of injection timing at the first and/or second injectable pressure level.

The injector may include a valve needle that itself has a surface exposed to fuel pressure within the control chamber, so that by controlling fuel pressure within the control chamber by means of the nozzle control valve, opening and closure of the valve needle can be controlled.

The supply means may take the form of a transfer pump for supplying fuel at the supply pressure level. It will be appreciated, however, that whilst the supply means of the system may include the transfer pump, the system need not include the pump, and may be manufactured without it, in which case the supply means may simply take the form of an inlet to the first rail volume.

According to a second aspect of the present invention, there is provided an accumulator assembly for a common rail fuel system having a plurality of unit pumps, the accumulator assembly including an accumulator housing within which is defined a first accumulator volume for fuel at a supply pressure level and a second accumulator volume for fuel at an injectable pressure level, wherein the accumulator housing is provided with a plurality of openings, each for receiving one of the unit pumps, in use, so as to permit communication between respective pump chambers of the unit pumps and the first accumulator volume internally within the accumulator housing.

It will be appreciated that any one or more of the preferred and/or optional features described previously for the first aspect of the invention may be included as preferred or optional features of the second aspect of the invention also.

Embodiments of the present invention will now be described, by way of example only, with reference to the accompanying drawings in which:

BRIEF DESCRIPTION OF THE DRAWINGS

FIG. 1 is a diagrammatic view to show a fuel system of a first embodiment of the present invention, FIG. 5 is an end view of a part of the fuel system in FIG. 1, to illustrate how one of the unit pumps of the system is integrated within the rail assembly housing.

DETAILED DESCRIPTION OF THE DRAWINGS

Figure 2:
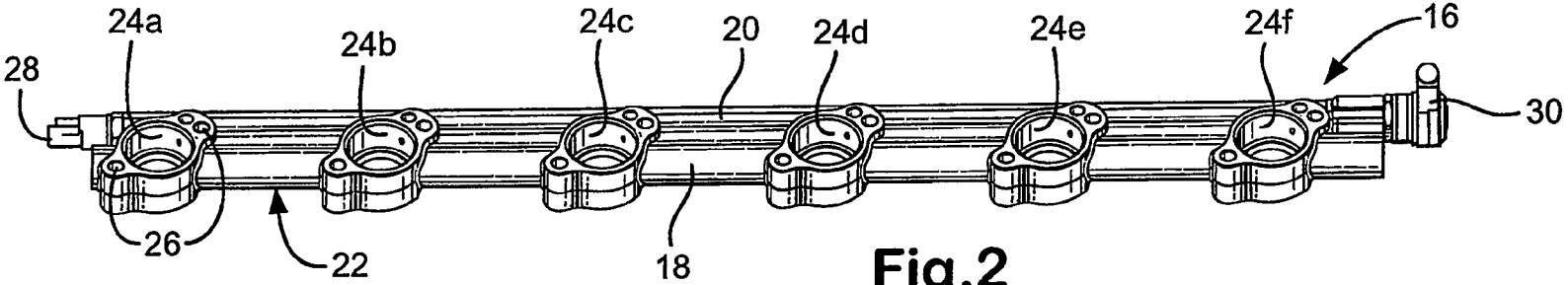
FIG. 2 is a diagrammatic view of a rail assembly of the fuel system in FIG. 1.
Figure 4:
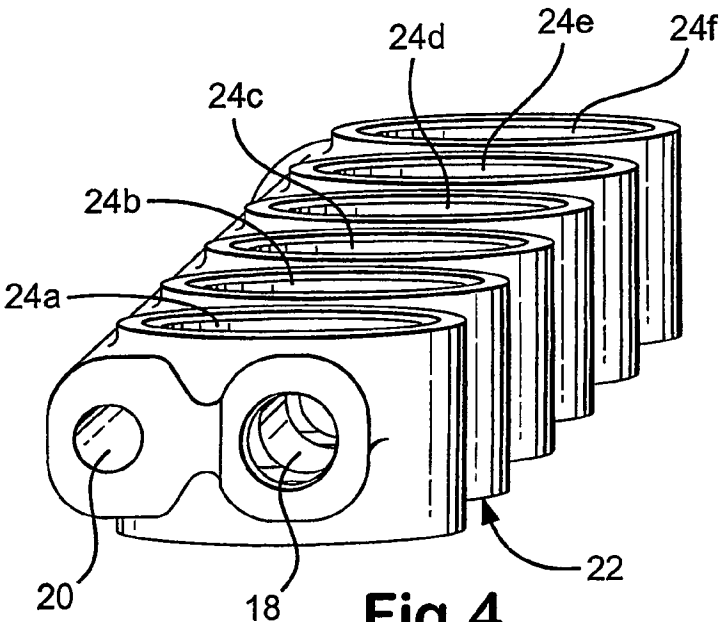
FIG. 4 is a perspective view, from one end, of the rail assembly in FIGS. 1 to 3.

Referring to FIG. 1, there is shown a fuel system for supplying fuel to a plurality of fuel injectors 14*a*-14*f* (six of which are shown), each of which is supplied with fuel at an injectable pressure through respective high pressure supply lines or passages 12*a*-12*f*. The fuel system includes pump means in the form of a plurality of unit pumps 10*a*-10*f*, each of which is dedicated to a respective one of the injectors 14*a*-14*f*. Each unit pump 10*a*-10*f* is of a generally similar type to the known Electronic Unit Pump (EUP), as described previously, although the significant modifications to the construction and operation will be described in further detail later.

The unit pumps 10*a*-10*f* are integrated with a rail assembly, referred to generally as 16, including first and second accumulator or rail volumes defined by first and second rails 18, 20. The first rail 18 receives fuel at relatively low pressure from a fuel supply means (not shown in FIG. 1) including a rail inlet. Typically the fuel supply means also includes a transfer pump feeding fuel to the rail inlet. The second rail 20 receives fuel which has been pressurised to an injectable pressure level by the unit pumps 10*a*-10*f*. The first and second rails 18, 20 are arranged adjacent to and in parallel with one another and are defined or integrated within a common accumulator housing in the form of a rail housing 22. When assembled with the rail assembly 16, the unit pumps 10*a*,10*b* define an "integrated rail/pump assembly".

The rail assembly 16 will now be described in further detail with reference to FIGS. 2 to 5. In FIG. 5, only a first one of the unit pumps 10a is visible and this illustrates the location of the unit pump 10*a* relative to the rail housing 22. The rail housing 22 is provided with a plurality of cross bores or openings 24*a*-24*f*, each of which extends through the housing 22 so as to intersect, and interrupt, the first rail volume 18. Each unit pump 10*a*-10*f* is mounted within the rail assembly 16 so that its pump chamber (not visible) is able to communicate with the first rail 18 at points internally within the rail housing 22, therefore avoiding the need for external pipe connections and external seals between the unit pump 10*a*-10*f* and the rails 18, 20. It is a further feature of the mounting of the unit pumps 10*a*-10*f* within the assembly that the pump chamber of each unit communicates with the second rail 20 internally within the pump/rail assembly via internal interface seals between faces of the unit pump housing and the rail housing 22, as described in further detail later.

The total number of openings 24*a*-24*f* provided in the rail housing 22 is equal to the number of unit pumps 10*a*-10*f* of the system (i.e. six in the example shown), so that each opening receives a respective one of the unit pumps 10*a*-10*f* when the system is assembled. Appropriate fixing points 26, for example bolt holes, are provided for each opening 24*a*-24*f* (indicated for the first opening 24*a* only) to provide a means of fixing or clamping each unit pump 10*a*-10*f* to an engine housing (not identified), typically the engine cylinder block, when it is received within its opening 24*a*-24*f*. Each unit pump 10*a*-10*f* sits within the opening 24*a*-24*f* so that its longitudinal axis intersects the longitudinal axis of the first rail 18.

Figure 3:
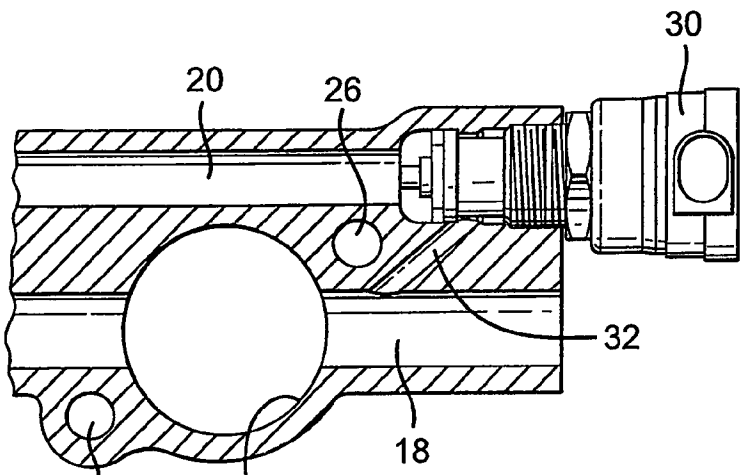
FIG. 3 is a top view of one end of the rail assembly in FIG. 2, to show a pressure relief valve of the first rail.

One end of the second rail 20 is provided with a pressure sensor 28 which senses the pressure of fuel within the second rail 20 and provides an output signal to an Engine Control Unit (ECU) (not shown). A pressure relief valve 30 is provided at the opposite end of the second rail 20. The pressure relief valve 30 is electronically controllable by the ECU, which controls the pressure relief valve in response to the rail pressure sensor output signal so as to prevent over-pressurisation of fuel within the second rail 20. A return drilling 32 is provided in the rail housing 16, as shown in FIG. 3, to provide a flow path for fuel that is relieved through the valve 30 into the first rail 18 at lower pressure.

Figure 6:
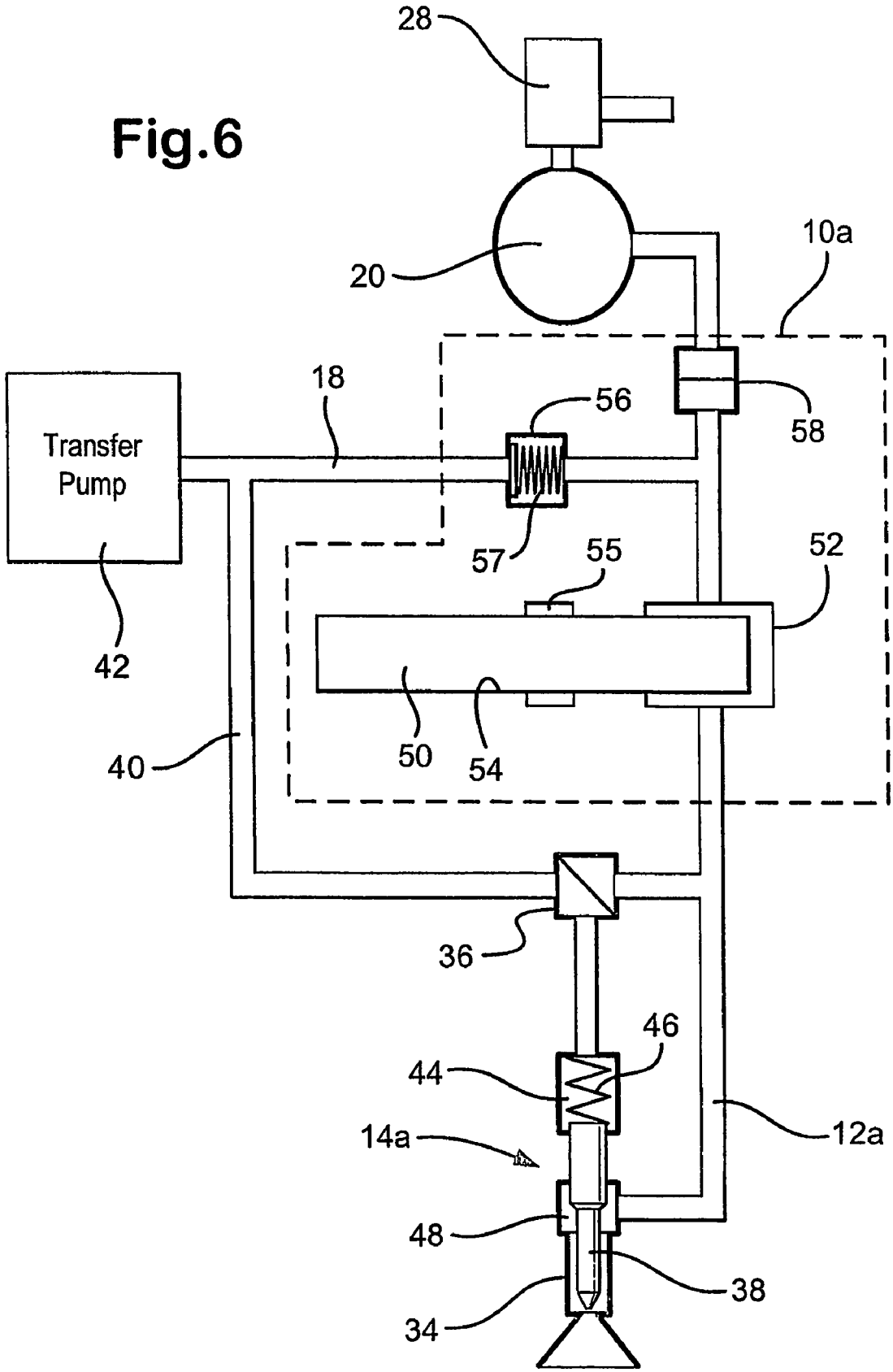
FIG. 6 is a schematic view of the fuel system in FIG. 1.

FIG. 6 shows the hydraulic arrangement of the unit pumps 10*a*-10*f*, the first and second rails 18, 20 and the injectors 14*a*-14*f*. For simplicity only a single injector 14*a* and its dedicated unit pump 10*a* are shown in FIG. 6 in relation to the first and second rails 18, 20 although, as will be apparent from the foregoing description, the first and second rails 18, 20 are common to all injectors 14*a*-14*f* and all unit pumps 10*a*-10*f* of the system. Only a single one of the unit pumps 10*a* and a single one of the injectors 14*a* will be described in detail, as all unit pumps and all injectors are substantially identical.

The injector 14*a* includes an injection nozzle 34 and a control valve means in the form of a nozzle control valve 36 (alternatively referred to as a needle control valve), which is arranged to control movement of a valve needle 38 so as to control the delivery of fuel from the injection nozzle 34. The valve needle 38 is engageable with a valve needle seating and movement of the valve needle 38 away from the seating permits fuel to flow through one or more injection nozzle outlets (not indicated) into the associated engine cylinder or other combustion space.

The nozzle control valve 36 is arranged within a flow path 40 between fuel supply means 42, which may be within the cylinder block, and an injector control chamber 44 arranged at the back end of the valve needle. A surface of the valve needle 38 is exposed to fuel pressure within the control chamber 44, so that fuel within the control chamber 44 applies a force to the valve needle 38 which serves to urge the valve needle 38 against its seating. The valve needle 38 is provided with a needle spring 46, housed within the control chamber 44, which also serves to urge the needle 38 towards its closed or seated position. The fuel supply means takes the form of a transfer pump 42 for supplying fuel at relatively low pressure, typically between 3 and 7 bar, to the flow path 40.

The injection nozzle 34 includes a delivery chamber 48 which receives fuel at an injectable pressure level through the supply passage 12*a*, and from where fuel is supplied to the injection nozzle outlets when the valve needle 38 is unseated. It will be appreciated by comparing FIG. 1 and FIG. 6 that the high pressure supply passage 12*a* between the unit pump 10*a* and its injector 14*a* in FIG. 1 is hydraulically equivalent to the identically numbered passage in FIG. 6. It will now also be appreciated that the flow path 40, identified in FIG. 6, between the transfer pump 42 and the injector 10*a* is not shown in FIG. 1 but may be, for example, through a gallery or rail in the cylinder head or block of the engine.

The nozzle control valve 36 is movable between a first position (open) and a second position (closed). When the nozzle control valve 36 is opened, the supply passage 12*a* communicates with the control chamber 44 of the injector so that high fuel pressure within the chamber 44 acts on valve needle 38, in combination with the needle spring 46, to seat the valve needle 38. When the nozzle control valve 36 is closed, the control chamber 44 communicates with the transfer pump 42 and communication between the supply passage 12*a* and the control chamber 44 is broken, so that the pressure of fuel within the control chamber 44 acting on the valve needle is reduced. By closing the nozzle control valve 36, the valve needle 38 is thus caused to lift due to high pressure fuel acting on valve needle thrust surfaces which are exposed to fuel pressure within the delivery chamber 48. Operation of the nozzle control valve 36 to control fuel pressure within the control chamber 44 therefore provides a means of controlling valve needle movement towards and away from its seating to control injection.

FIG. 6 also shows the second rail 20 and the rail pressure sensor 28 (as shown in FIG. 1). Communication between the second rail 20 and the pump chamber 52 is controlled by means of an electrically controllable valve in the form of a rail control valve 58 forming part of the unit pump 10*a*.

Each unit pump (e.g. 10*a*) has a pumping element or plunger 50 and a pump chamber 52 in communication with one end of the supply passage 12*a*. The plunger 50 is movable within a plunger bore 54 provided in a unit pump housing (not identified) under the influence of a cam drive arrangement (not shown in FIG. 6) so as to pressurise fuel within the pump chamber 52. The plunger bore 54 is provided with an internal groove 55, or an enlarged diameter region, which serves to collect leakage fuel from the pump chamber 52 down the plunger bore 54 and drains to a low pressure drain, as described in further detail later.

The pump chamber 52 also communicates with the transfer pump 42 through a supply passage which is hydraulically equivalent to the first rail 18. This supply passage, or first rail 18, is provided with a hydraulically operable non-return valve 56 provided with a non-return valve spring 57, and receives fuel at relatively low pressure from the transfer pump 42, in use. If the non return valve 56 is in its open position, the transfer pump 42 is able to supply fuel to the pump chamber 52 at a relatively low pressure through the first rail 18. If the non return valve 56 is in the closed position the communication path between the pump chamber 52 and the first rail 18, and hence the transfer pump 42, is closed off.

Figure 8:
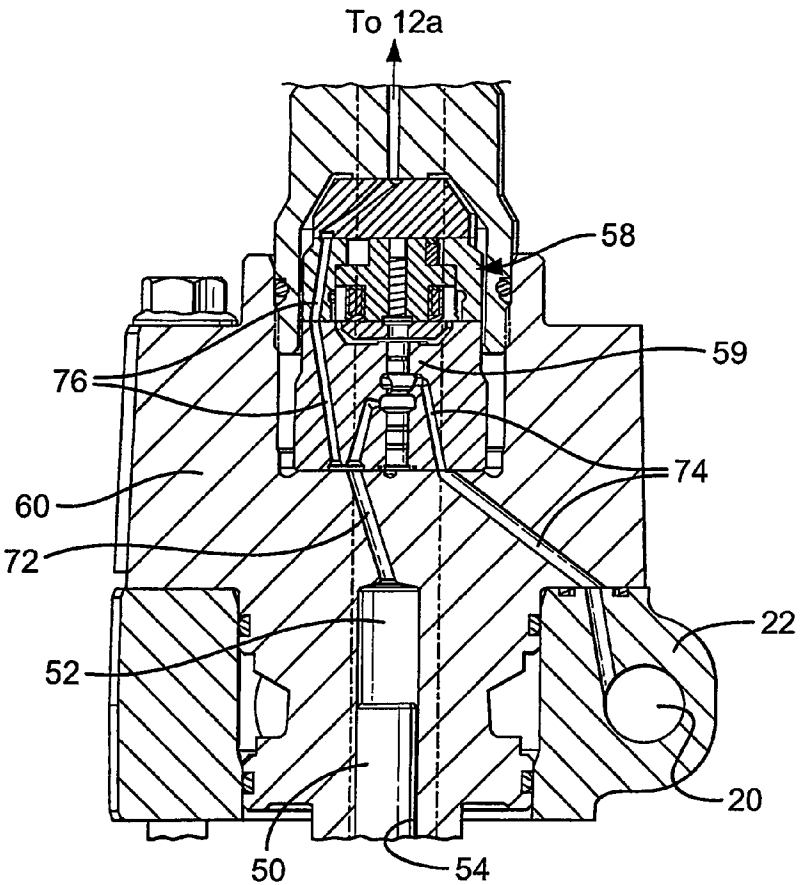
FIG. 8 is an alternative sectional view of the unit pump to that shown in FIG. 7, to illustrate high pressure and rail circuits of the unit pump.
Figure 7:
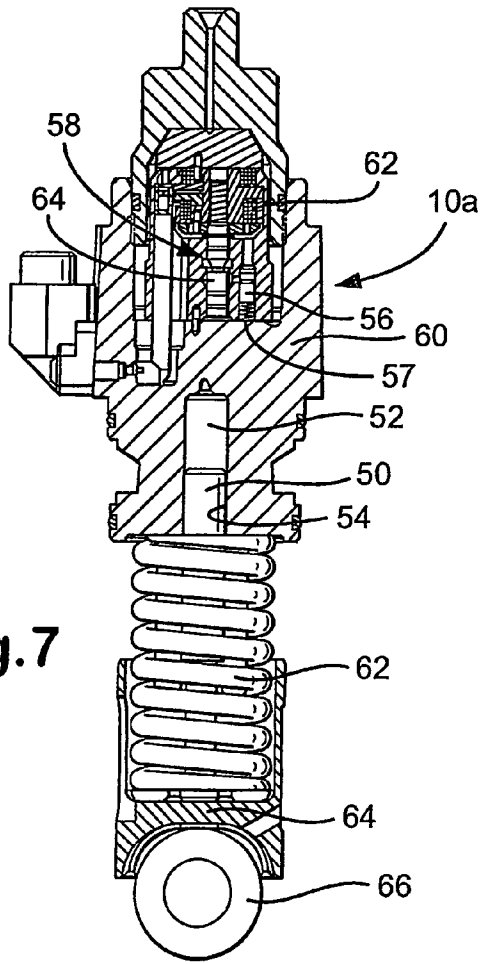
FIG. 7 is a sectional view of a unit pump forming part of the fuel system in FIGS. 1 and 6.

The construction of the unit pump 10*a* is shown in further detail in FIGS. 7 and 8. The unit pump 10*a* includes a unit pump housing 60 which is provided with the bore 54 within which the plunger 50 moves and within which the pump chamber 52 is defined. The plunger 50 has an associated plunger return spring 62 and a tappet drive member 64 (also identified in FIG. 1 as 64*a*-64*f*), as is common in a known EUP. The tappet 64 co-operates with a roller 66 which rides over the surface of the cam so as to impart drive to the tappet 64 and, hence, to the plunger 50 so as to effect a plunger pumping stroke, during which the plunger 50 is driven inwardly within the bore 54 to reduce the volume of the pump chamber 52. The plunger return spring 62 serves to drive a return stroke of the plunger 50, during which the plunger 50 is urged outwardly from the bore 54, increasing the volume of the pump chamber 52.

The rail control valve 58 and the non-return valve 56 are housed, adjacent to one another, within a rail control valve housing 59 located at an upper end of the unit pump 10*a*. The rail control valve 58 is operable by means of an electromagnetic actuator arrangement including an energisable winding 62 and an armature (not identified) coupled to a rail control valve member 64 so that energisation and de-energisation of the winding 62 causes movement of the rail control valve member 64 to open and close the rail control valve 58.

The pump chamber 52 communicates with an outlet passage 72 defined by a drilling provided in the unit pump housing 60 which, in turn, communicates with the supply passage 12*a* through a high pressure circuit 76 provided in the various housing parts. The outlet passage 72 also communicates with a rail circuit 74 defined by drillings in various housing parts, depending on the position of the rail control valve 58.

The fuel system is capable of providing injection at first and second injectable pressure levels, depending upon the operating state of the rail control valve 58. In a first mode of operation, the system operates in a common rail-type mode in which plunger movement has minimal or no effect on the pressure level in the pump chamber 52 due to the rail control valve 58 being open, and fuel at the first, moderate rail pressure, which is stored in the second rail 20, is delivered to the injector 14*a*. In a second mode of operation the system operates in an EUP-type mode in which plunger movement increases the pressure level to a second higher level, due to the rail control valve 58 being closed, and fuel at this higher level is delivered to the injector 14*a*.

To clarify, when the rail control valve 58 is opened, the pump chamber 52 of the unit pump 10*a* communicates with the second rail 20 through the rail circuit 74 and also with the supply passage 12*a*. When the rail control valve 58 is closed the communication path (i.e. the rail circuit 74) between the pump chamber 52 and the second rail 20 is broken, and instead the pump chamber 52 communicates only with the supply passage 12*a* (through the high pressure circuit 76). Actuation and de-actuation of the rail control valve 58 is controlled by means of control signals supplied by the ECU. The operating state of the nozzle control valve 36 determines whether injection takes place and, thus, provides a control means for the timing of commencement and termination of injection.

Various modes of operation of the fuel system will now be described in further detail, particularly with reference to FIGS. 6 to 8.

In use, during a return stroke of the plunger 50, the volume of the pump chamber 52 is expanding and, with the rail control valve 58 closed, a point will be reached at which the non-return valve 56 opens to permit fuel to be supplied to the pump chamber 52. At the start of the plunger pumping stroke the non-return valve 56 is still open. As the driven tappet 64 acts on the plunger 50 it is urged inwardly within the bore 54, thereby reducing the volume of the pump chamber 52. With the rail control valve 58 closed, movement of the plunger 50 through the pumping stroke causes fuel pressure within the pump chamber 52 to be increased. As the pressure differential across the non-return valve 56 increases, due to increasing fuel pressure within the pump chamber 52 acting in combination with the valve spring 57, a point will be reached at which the non-return valve 56 is caused to close. Further movement of the plunger 50 through the pumping stroke causes fuel pressure within the pump chamber 52 to increase further, until such time as the rail control valve 58 is opened to permit pressurised fuel, at a first pressure level, to fill the second rail 20.

During this first mode of operation the pressure level (referred to as the first pressure level) to which fuel within the pump chamber 52 is pressurised is higher than transfer pressure supplied by the pump 42, but typically is less than the pressure that would be achieved by a high pressure common rail-type pump. Typically, for example, this first pressure level may be up to about 1000 bar. If the rail control valve 58 is opened during the period for which the non return valve 56 is closed, fuel at the first injectable pressure level is supplied, via the outlet passage 72 and the rail circuit 74, to the second rail 20. Fuel at this first injectable pressure level also fills the supply passage 12*a* through the drilling 76 and, hence, supplies fuel at the first injectable pressure level to the injection nozzle 34.

Continued plunger movement through its pumping cycle causes fuel at the first pressure level to be supplied to and drawn out of the pump chamber 52 through the open rail control valve 58, with the unit pumps 10*a*-10*b* being operable in a phased cyclical manner so that fuel volume that is displaced from one pump chamber 52 of one unit pump and supplied to the second rail 20 during its pumping stroke coincides with fuel within the second rail 20 being supplied to the pump chamber 52 of another unit pump during its return stroke, so as to maintain rail fuel volume.

In order to inject fuel at the first injectable pressure level, the nozzle control valve 36 is actuated to move into its closed position so that fuel in the control chamber is able to return to the transfer pump 42, therefore allowing the valve needle 38 to open. Injection may be terminated by actuating the nozzle control valve 36 to move into its open position so that high fuel pressure is re-established within the control chamber 44 to seat the needle 38.

If the rail control valve 58 is closed during the plunger pumping stroke (i.e. with the non return valve 56 closed) the pressure of fuel within the pump chamber 52, which during the start of the pumping stroke is held at about 1000 bar, will be increased during the pumping stroke of the plunger 50 to a second pressure level that is higher than the first as fuel can no longer flow into and out of the second rail 20. Typically, this second injectable pressure level may be between 2000 and 3000 bar. With the rail control valve 58 closed, injection at the second injectable pressure level is initiated by actuating the nozzle control valve 36 to allow the control chamber to communicate with the transfer pump 42, as described previously. In a similar manner termination of injection at the second injectable pressure level may be implemented by actuating the nozzle control valve 36 to re-establish high fuel pressure within the control chamber 44.

In order to re-fill the second rail 20 following an injection event, the rail control valve 58 is closed during the plunger return stroke. As the plunger withdraws from the pump chamber 52, increasing the pump chamber volume, the pressure drop across the non-return valve 56 causes it to open, permitting a supply of new fuel into the pump chamber 52 ready for the next pumping cycle.

If the rail control valve 58 is opened during the pumping stroke it will be appreciated that the non-return valve 56 stays closed due to pressure within the pump chamber 52 being higher than transfer pressure.

It will be appreciated that the timing of operation of the rail control valve 58 is important, so as to ensure that fuel is pressurised within the pump chamber 52 to the second pressure level at the required time (i.e. by closing the rail control valve 58) and also to ensure fuel is supplied to the pump chamber 52 by the pump 42 following an injection event. In practice, for example, the duration for which the valve 58 is open, and the relative timing of its opening and closure, will be controlled by control signals provided by the engine controller in accordance with look-up tables or data maps containing pre-stored information. The implementation of look-up tables and data maps for control of engine fueling and timing would be familiar to a person skilled in this technical field.

It is a further feature of the fuel system of FIGS. 1 to 7 that should it be desirable to reduce the pressure of fuel that is stored within the second rail 20, the pressure relief valve 30 can be opened to permit fuel within the second rail 20 to flow into the first rail 18 at lower pressure through the return drilling 32 (as shown in FIG. 3).

It is one advantage of the invention that an injection event comprising a pilot injection of fuel at a first, moderate pressure level followed by a main injection event at a second, higher pressure level can be achieved by switching the rail control valve 58. It has been found that this combination of a pilot followed by a main injection of fuel provides a benefit for emission levels and noise. The fuel system can also be used to implement a main injection of fuel at a higher pressure level followed by a late, post injection of fuel at a lower pressure level. This can be useful for after-treatment purposes. A boot-shaped injection characteristic, comprising an initiate higher rate fuel injection immediately followed by a lower rate injection, can also be achieved through rapid switching of the rail control valve 58 and the nozzle control valve 36, when appropriate.

It is a further advantage of the invention that the locality of the first rail 18 to the second rail 20 provides benefits for cooling of the second rail, as cooler lower pressure fuel (i.e. at transfer pressure) within the first rail 18 provides a cooling effect for higher pressure fuel within the second rail 20. In an alternative embodiment (not illustrated), the rail/pump assembly may also be provided with means for feeding fuel pressure within the first rail 18 to a low pressure drain, thereby improving the cooling effect of the first rail further. For example, an additional feed drilling or passage may be provided in the rail housing 22 in communication, at one end, with the first rail 18 and communicating at the other end with the low pressure drain.

Another benefit is achieved in that the hydraulic connection between the first rail and the unit pump 10*a* is internally within the rail housing 22. The need for additional pipework, additional connections and additional seals is therefore avoided. It is also an advantage that the hydraulic connection between the second rail 20 and the unit pump 10*a* is internally within the rail/pump assembly, at the interface between the unit pump housing 60 and the rail housing 22 (as can be seen in FIG. 8), and so the need for external high pressure connections and seals is avoided here also.

The rail assembly 16 is also simple and convenient to manufacture and assemble. Once the rail housing 22 has been machined to provide the openings 24*a*-24*f*, each unit pump 10*a*-10*f*, in its fully assembled state, is inserted into a respective one of the openings 24*a*-24*f* so as to make the required communications between the pump chambers and the rails 18, 20. When the unit pumps 10*a*-10*f* are inserted into the openings 24*a*-24*f*, the appropriate fixing means are then inserted through the bolt holes to secure the unit pumps 10*a*-10*f* in position.

In a further modification to that described previously, a third rail volume may be provided within the rail housing 22. The third rail volume may be arranged adjacent to, or in side by side arrangement with the first and second rails 18, 20 and may be arranged to communicate, through an additional drilling in the unit pump, with the plunger leakage groove 55.

In an alternative embodiment of the invention to that described previously, the injector 14*a*-14*f* associated with each unit pump 10*a*-10*f* may itself form part of the unit pump 10*a*-10*f* (i.e. within a common housing), in an EUI-type arrangement. The EUI has a first injector end, at which the injector is arranged, and an opposite pump end, at which the pumping elements are arranged. It will be appreciated that either the injector end of the EUI or the pump end of the EUI may be inserted into the respective opening 24*a*-24*f* to mount the unit within the rail assembly 16. As before, the unit pump incorporating the injector is mounted within its respective opening 24*a*-24*f* so that the pump chamber of each EUI communicates with the rail internally within the accumulator housing 22.

It will be appreciated that although the embodiment of the invention described previously includes a rail control valve 58 for permitting the system to switch between first and second injectable pressure levels, a rail control valve 58 that operates in this manner is not an essential element of the invention. The first and second rails 18, 20 may be provided to give the aforementioned advantages in an EUP-accumulator type system, even if the system is configured to enable fuel injection at only one injectable pressure level.

The invention claimed is:

1. A fuel system for supplying pressurised fuel to a plurality of fuel injectors, the fuel system comprising:

an accumulator assembly having first and second accumulator volumes defined within a common accumulator housing, supply means for supplying fuel at a supply pressure level to the first accumulator volume, and a plurality of unit pumps for receiving fuel at the supply pressure level from the first accumulator volume and for pressurising said fuel to first injectable pressure level for supply to the second accumulator volume, wherein each unit pump includes a pumping plunger for pressuring fuel within an associated pump chamber and wherein each unit pump is integrated with the common accumulator housing by mounting within an opening or cross bore provided therein so as to pass through the common accumulator housing so as to permit communication between the pump chamber and, respectively, the first accumulator volume and the second accumulator volume internally within the accumulator housing.

2. The fuel system as claimed in claim 1, wherein the accumulator assembly is a rail assembly comprising a first rail volume and a second rail volume housed within a rail housing.

3. The fuel system as claimed in claim 2, wherein the first rail volume communicates with the pump chamber of each unit pump internally within the accumulator housing via first valve means.

4. The fuel system as claimed in claim 3, wherein the first rail volume is communicable with the pump chamber of each unit pump through a non-return valve having an open position, in which the pump chamber communicates with the first rail volume, and a closed position in which said communication is broken.

5. The fuel system as claimed in claim 4, wherein the second rail volume is communicable with the pump chamber of each unit pump through second valve means.

6. The fuel system as claimed in claim 5, wherein the second valve means is a rail control valve operable between an open position in which fuel at the injectable pressure level, being a first injectable pressure level, is supplied from the second rail volume to the injectors and a closed position in which communication between the pump chamber of a unit pump and the second rail volume is broken so that the unit pump is operable to increase fuel to a second injectable pressure level.

7. The fuel system as claimed in claim 6, wherein the rail control valve includes an electro-magnetically operable valve which is movable between the open and closed positions by application of an electrical control signal.

8. The fuel system as claimed in claim 2, wherein the supply means includes a transfer pump for supplying fuel at supply pressure to the first rail volume and, hence, to each unit pump through the first valve means.

9. The fuel system as claimed in claim 2, wherein the first and second rail volumes are arranged side-by-side, or substantially in parallel with one another, within the rail housing.

10. The fuel system as claimed in claim 1, including a plurality of injectors for receiving fuel at an injectable pressure level from the pump chamber of an associated unit pump and/or from the second accumulator volume.

11. The fuel system as claimed in claim 10, including a plurality of unit pumps each of which forms a common unit with one of the injectors.

12. The fuel system as claimed in claim 1, including nozzle control valve means operable to control the timing of commencement of injection at a first and/or a second injectable pressure level.

13. The fuel system as claimed in claim 12, wherein the nozzle control valve means includes a nozzle control valve that is operable to control fuel pressure within an injector control chamber so as to permit control of injection timing at the first and/or the second injectable pressure level.

14. An accumulator assembly for a common rail fuel system having a plurality of unit pumps, the accumulator assembly including a common accumulator housing, within which is defined a first accumulator volume for fuel at a supply pressure level and a second accumulator volume for fuel at a first injectable pressure level, wherein the common accumulator housing is provided with at least one opening, within which a unit pump is receivable, in use, so that a pump chamber of each unit pump is communicable, respectively, with the first accumulator volume and the second accumulator volume internally within the common accumulator housing.

15. The accumulator assembly as claimed in claim 14, wherein the first accumulator volume is a first rail volume and the second accumulator volume is a second rail volume, both of which are defined within a rail housing.

* * * * *